US006222929B1

(12) United States Patent
Kim

(10) Patent No.: US 6,222,929 B1
(45) Date of Patent: Apr. 24, 2001

(54) SPEAKER HAVING MIDDLE-HIGH SOUND SPEAKERS

(75) Inventor: Jae-Nam Kim, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/184,581

(22) Filed: Nov. 3, 1998

(30) Foreign Application Priority Data

Nov. 3, 1997 (KR) ..... 97-57637

(51) Int. Cl.[7] ..... H04R 25/00

(52) U.S. Cl. ..... 381/182; 381/186; 381/335; 381/338; 381/342; 181/144; 181/199

(58) Field of Search ..... 381/182, 152, 381/186, 335, 336, 338, 342, 386, FOR 165; 181/144, 145, 147, 199

(56) References Cited

U.S. PATENT DOCUMENTS 2,295,527 * 9/1942 Bowley ..... 381/342
4,492,826 * 1/1985 Chiu ..... 381/182
4,811,406 * 3/1989 Kawachi ..... 381/186
4,837,839 * 6/1989 Andrews ..... 381/182

* cited by examiner

*Primary Examiner*—Curtis Kuntz
*Assistant Examiner*—Suhan Ni
(74) *Attorney, Agent, or Firm*—Staas & Halsey LLP

(57) ABSTRACT

A speaker apparatus, in which a middle-high frequency speaker is disposed forward of a low frequency speaker. First and second sound guiding member are disposed in front of the low frequency speaker and middle-high frequency speaker improving low sound while reducing noise and distortion. The speaker includes a yoke having a path arranged at rear side of a woofer with the first sound guiding member disposed in the yoke for guiding sound discharged through the path. A tweeter is disposed at the front end of the first sound guiding member. A partition wall is disposed at the edge of the tweeter for separating middle-high frequency sound from low sound radiated from the woofer, and the second sound guiding member is disposed at the central portion of the tweeter.

9 Claims, 1 Drawing Sheet

SPEAKER HAVING MIDDLE-HIGH SOUND SPEAKERS

CROSS-REFERENCE TO RELATED APPLICATIONS

This application claims the benefit of Korean Application No. 97-57637, filed Nov. 3, 1997, in the Korean Patent Office, the disclosure of which is incorporated herein by reference.

BACKGROUND OF THE INVENTION

1. Field of the Invention

The present invention relates to a speaker and, more particularly, to a speaker in which a middle-high frequency speaker is disposed in front of a low frequency speaker and a sound guiding member is disposed behind the low frequency speaker and in front of the middle-high sound speaker improving low frequency sound while lowering noise and distortion.

2. Description of the Related Art

Generally, a speaker converts an electrical signal into a sound wave signal and radiates a sound wave through free space. That is, an electric current flows through a voice coil disposed in a strong magnetic field, generally a magnet, so as to generate a force causing a vibrating plate to vibrate radiating the sound wave.

FIG. 1 is a cross-sectional diagram of a conventional speaker. In general, a conventional speaker includes a vibrating plate 11 (also known as a "cone 11) attached to a frame 10, a bobbin 12, a voice coil 13 inside the frame 10, a damper 14 disposed between the frame 10 and the bobbin 12, an upper plate 15, a magnet 16, and a polepiece 17 disposed behind the frame 10. The voice coil 13 is wound on the outer side of the cylindrical-shaped bobbin 12 and moves integrally with the bobbin 12. The bobbin 12, is connected at a front end thereof, with a lower side of the vibrating plate 11 and is supported by the elastic damper 14. The polepiece 17 is disposed at a predetermined distance from the inner side of the bobbin 12. The region between the polepiece 17 and the upper plate 15 receives the magnetic field from the magnet 16.

The bobbin 12 vibrates axially, by the Fleming's left hand law, when current passes through the voice coil 13. The vibration of the bobbin causes the vibrating plate 11, disposed forward of the bobbin 12, to vibrate thereby radiating sound waves through free space. Since a speaker can not reproduce all ranges of sound, it is necessary to provide a tweeter for high sound, a squawker for middle sound, and a woofer for low sound to obtain the highest quality sound. However, the size of a cabinet to accommodate all three speakers, must, by necessity, be quite large, increasing the costs of the speaker.

SUMMARY OF THE INVENTION

The present invention has as an object to provide a speaker apparatus which can reproduce all ranges of sound such as low, middle, and high frequency sound in a small cabinet.

It is another object of the present invention to provide a speaker apparatus which can make sound more clear and stereophonic by reducing the distortion or noise due to the collision of sound.

In order to achieve the objects of the invention, a speaker apparatus according to the present invention includes: a yoke having a path arranged at the rear side of a woofer for low sound; a sound guiding member disposed in the yoke for guiding sound discharged through the path; a tweeter for reproducing middle to high frequency sound disposed at the front end of the sound guiding member; a partition wall disposed at the edge of the tweeter for separating the middle-high frequency sound from the low frequency sound radiated from the woofer; and a sound guiding member disposed at the central portion of the tweeter.

As described above, in a speaker apparatus according to the present invention, the tweeter is disposed at the front side of the woofer. To improve low frequency sound, the low frequency sound radiated toward the rear direction of the woofer is passed through the sound guiding member disposed within the yoke minimizing the collision with the turbulent flow generated from the rear sound and reducing noise and the distortion of sound. Middle-high frequency sound radiated from the tweeter is radiated and separated from the low frequency sound radiated from the woofer by a partition wall and at the same time guided by a sound guiding member disposed in front of the woofer to improve ambience and stereophonic quality.

BRIEF DESCRIPTION OF THE DRAWINGS

These and other objects and advantages of the invention will become more apparent and more readily appreciated from the following detailed description taken in conjunction with the accompanying drawings of which.

DETAILED DESCRIPTION OF THE PREFERRED EMBODIMENT

Figure 1:
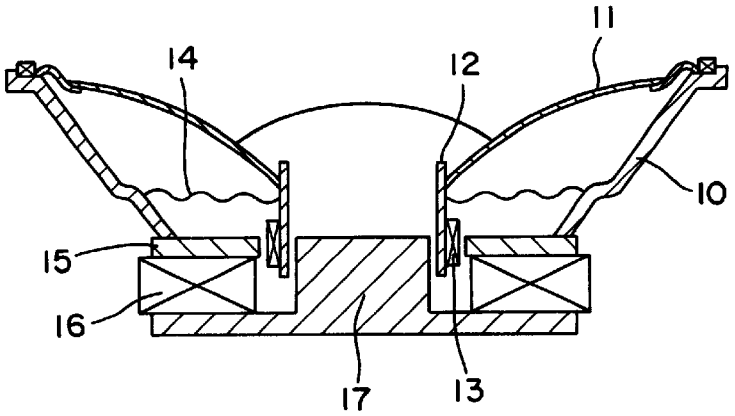
FIG. 1 (PRIOR ART)
FIG. 1 is a cross sectional diagram of a conventional speaker.

Reference will now made in detail to a preferred embodiment of the present invention, an example of which is illustrated in the accompanying drawings, wherein like reference numerals refer to the like elements throughout.

Figure 2:
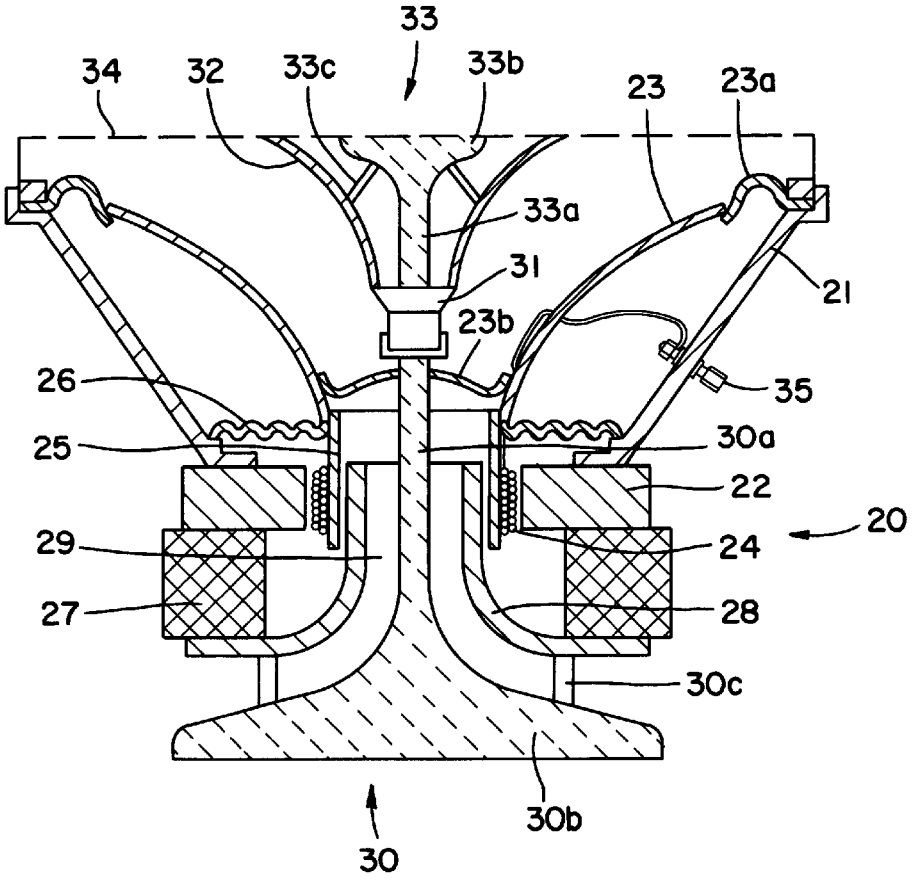
FIG. 2 is a cross sectional diagram of a speaker according to a preferred embodiment of the present invention.

FIG. 2 is a cross sectional diagram of a speaker according to a preferred embodiment of the present invention. A speaker in accordance with a preferred embodiment of the present invention is constructed by placing a tweeter 31 within a woofer 20. A frame 21 has a lower side attached to an upper plate 22. The frame 21 has an upper side attached with an upper side of a vibrating plate 23 via an edge 23*a*. The vibrating plate 23 has a lower side connected to a bobbin 25 about which is wound a voice coil 24. The bobbin 25 is movably supported by the frame 21 via a damper 26 secured to the frame 21.

A yoke 28 is held at a distance from to a lower side of the upper plate 22 by way of a magnet 27. The yoke 28 is disposed within the bobbin 25 and extends rearward from the bobbin 25. The outer edge of the yoke 28 is a predetermined distance from the inner edge of the bobbin 25. The yoke 28 forms a path 29 for radiating the rear sound. A sound guiding member 30, formed within the yoke 28, guides the rearward radiated sound to the rear of the woofer 20. The sound guiding member 30 is preferably of a solid construction, but may be hollow.

The sound guiding member 30 includes a column 30*a* disposed in the path 29, at a predetermined distance from the walls of the yoke 28, and a guiding plate 30*b*, formed at the front end of the column 30*a*. The guiding plate 30*b* protrudes from the yoke 28 and is supported by the yoke 28 via a boss portion 30*c* connected between the yoke 28 and the guiding plate 30*b*. It is preferable that the guiding plate 30*b* is cylindrical in shape. The column 30*a* of the sound guiding member 30 has upper end extending into the space defined by the vibrating plate 23. The column 30*a* is connected to the vibrating plate 23 by a membrane 23*b*, preferably glued to the column 30*a*. The column 30*a* supports the tweeter 31.

The tweeter 31 reproduces high frequency sound and preferably reproduces middle to high frequency sound. The edge of the tweeter 31 is provided with a partition wall 32 partitioning the forward radiated sound from the tweeter 31 from the forward radiating sound from the vibrating plate 23. A sound guiding member 33, for guiding sound to be radiated in the front direction, is formed within the partition wall 32. The sound guiding member 33 is preferably of a solid construction, but may be hollow. The sound guiding member 33 includes a column 33*a* with a guiding plate 33*b* formed at the front end of the column 33*a*. A boss portion 33*c* connects an inner side of the partition wall 32 with the guiding plate 33*b*.

The frame 21 is provided with a cloth 34 covering the speaker opening for filtering noise and distorted sound included in the sound radiated from the frame 21. The frame 21 also has an input terminal 35 to supply power to the voice coil 24. When a current passes through the voice coil 24, from the input terminal 35, the bobbin 25 begins to vibrate axially, by way of the Fleming's left hand law, thereby radiating low frequency sound waves.

The low frequency sound waves radiate forward and rearward from the vibrating plate 23. The low frequency sound waves radiated toward the rear pass through the path 29 formed by the yoke 28, and are guided by the sound guiding member 30. This structure causes the sound waves to be radiated toward the rear direction. The high frequency sound waves radiated from the tweeter 31, disposed at the front end of the sound guiding member 30, are guided by the sound guiding member 33, disposed within the partition wall 32, causing the sound waves to be radiated toward the front of the sound guiding member 33.

The high frequency sound waves radiated from the tweeter 31 are separated from the forward radiating low frequency sound waves radiated from the vibrating plate 23 so that noise from the turbulent flow or distortion of sound waves is reduced. Forward radiating sound waves from the woofer 20 and the tweeter 31 are filtered by the cloth 34 further reducing noise or distortion, producing clearer sound with a high stereophonic quality.

While the invention has been particularly shown and described with reference to a preferred embodiment, it will be understood by those skilled in the art that various changes in form and detail may be made therein without departing from the spirit and scope of the invention. For example, the specific frequencies reproduced by the woofer 20 and the tweeter 31 can be selected based upon external factors, such as cabinet volume, presence of other speakers and costs.

What is claimed is:

1. A speaker apparatus comprising:

a woofer emitting low frequency sound;

a yoke forming a path at a rear side of the woofer;

a first sound guiding member disposed in the yoke guiding sound discharged into the path;

a tweeter emitting middle-high frequency sound disposed at a front end of the first sound guiding member;

a second sound guiding member disposed on a central portion of the tweeter; and a partition wall disposed at the edge of the tweeter separating the middle-high frequency sound emitted by the tweeter from the low frequency sound emitted from the woofer.

2. The speaker apparatus according to claim 1, wherein the first sound guiding member comprises a column extending through an axis of the woofer and a guiding plate connected to the column.

3. The speaker apparatus according to claim 1, further comprising a cloth covering the woofer.

4. A speaker, comprising:

a first speaker radiating sound waves in a forward and rearward direction, said first speaker comprising:

an upper plate provided with a central opening, a frame supported by said upper plate, a vibrating plate supported by said frame via a flexible edge, and a bobbin provided with a central opening, said bobbin positioned within the central opening of said upper plate such that the central opening of said bobbin is co-axial with the central opening of said upper plate, and said bobbin being connected to said vibrating plate;

a guide member extending through said first speaker via the central opening of said bobbin and guiding sound waves that said first speaker emits in the rearward direction; and a second speaker supported by said guide member in front of said first speaker.

5. A speaker, as set forth in claim 4, further comprising:

a yoke supported by said upper plate and extending rearward of said vibrating plate, said yoke defining a passage between the rear of said vibrating plate and the rear of the speaker, and wherein said guide member extends though the passage such that said yoke and said guide member, in combination, guide the sound waves that emit in a rearward direction from said first speaker.

6. A speaker, as set forth in claim 5, further comprising:

a magnet connecting said upper plate and said yoke.

7. A speaker, as set forth in claim 5, wherein said guide member comprises:

a central column extending through said first speaker;

a guiding plate formed rearward of said first speaker; and a support formed forward of said first speaker for supporting said second speaker.

8. A speaker, as set forth in claim 4, wherein said guide member comprises:

a central column extending through said first speaker;

a guiding plate formed rearward of said first speaker; and a support formed forward of said first speaker for supporting said second speaker.

9. A speaker, as set forth in claim 4, further comprising:

a coil wound around said bobbin; and a terminal, in electrical communication with said bobbin, extending through said frame.

* * * * *